US009775210B2

(12) United States Patent
Mishima

(10) Patent No.: US 9,775,210 B2
(45) Date of Patent: Sep. 26, 2017

(54) LIGHTING CIRCUIT, LUMINAIRE, AND ILLUMINATION SYSTEM

(71) Applicant: Panasonic Intellectual Property Management Co., Ltd., Osaka (JP)

(72) Inventor: Masanori Mishima, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/047,309

(22) Filed: Feb. 18, 2016

(65) Prior Publication Data

US 2016/0270177 A1 Sep. 15, 2016

(30) Foreign Application Priority Data

Mar. 9, 2015 (JP) ..... 2015-046466
Mar. 12, 2015 (JP) ..... 2015-050074

(51) Int. Cl.
*H05B 37/02* (2006.01)
*H05B 33/08* (2006.01)

(52) U.S. Cl.
CPC ..... *H05B 33/0848* (2013.01); *H05B 33/089* (2013.01)

(58) Field of Classification Search
CPC ..... H05B 33/0848; H05B 33/0884; H05B 33/0866; H05B 33/0875; H05B 37/02
See application file for complete search history.

(56) References Cited

U.S. PATENT DOCUMENTS 8,564,210 B2 10/2013 Hamamoto et al.
9,445,466 B2 * 9/2016 Angelin ..... H05B 33/0821
2011/0210675 A1 9/2011 Hamamoto et al.
2011/0260648 A1 * 10/2011 Hamamoto ..... H05B 33/0821 315/294

FOREIGN PATENT DOCUMENTS

JP 2011-181295 A 9/2011

* cited by examiner

*Primary Examiner* — Jimmy Vu
*Assistant Examiner* — Henry Luong
(74) *Attorney, Agent, or Firm* — Renner, Otto, Boisselle & Sklar, LLP

(57) ABSTRACT

A lighting circuit which supplies current to a solid-state light-emitting element module (LED module) including: a solid-state light-emitting element (LED); a first connection terminal connected to one end of solid-state light-emitting element; a third connection terminal connected to another end of the solid-state light-emitting element; and a second connection terminal, includes: a characteristics detector that detects one of open and short circuits between the third connection terminal and the second connection terminal; and a power controller that adjusts current that is supplied between the first connection terminal and the third connection terminal of the solid-state light-emitting element module, to a predetermined value greater than zero, when the characteristics detector detects one of the open and short circuits between the third connection terminal and the second connection terminal.

16 Claims, 13 Drawing Sheets

LIGHTING CIRCUIT, LUMINAIRE, AND ILLUMINATION SYSTEM

CROSS REFERENCE TO RELATED APPLICATION

This application claims the benefit of priority of Japanese Patent Application Number 2015-046466 filed on Mar. 9, 2015, and Japanese Patent Application Number 2015-050074 filed on Mar. 12, 2015, the entire content of which is hereby incorporated by reference.

BACKGROUND OF THE INVENTION

1. Field of the Invention

The present disclosure relates to a lighting circuit which supplies current to a solid-state light-emitting element module including a solid-state light-emitting element such as an LED (light-emitting diode), and to a luminaire and an illumination system that include the lighting circuit.

2. Description of the Related Art

A lighting circuit which supplies current to a solid-state light-emitting element module including a solid-state light-emitting element such as an LED, as well as a luminaire including the lighting circuit, are conventionally known (for example, PTL (Patent Literature) 1: Japanese Unexamined Patent Application Publication No. 2011-181295). In the technique disclosed in PTL 1, the solid-state light-emitting element module is so configured as to be removably attached to the lighting circuit. In a situation such as where the solid-state light-emitting element module is damaged, this configuration allows only the solid-state light-emitting element module to be replaced.

SUMMARY OF THE INVENTION

Furthermore, PTL 1 discloses a configuration of a solid-state light-emitting element module that includes a connection terminal for outputting characteristics setting signals in order that a plurality of solid-state light-emitting element modules having different electrical characteristics are available with a single lighting circuit. With this, the lighting circuit disclosed in PTL 1 aims to output, based on the characteristics setting signals, current adapted to the electrical characteristics of the solid-state light-emitting element modules.

However, PTL 1 discloses only the configuration of the solid-state light-emitting element module in which a circuit including a resistor, etc., is connected between the connection terminal and an output terminal, and fails to disclose the configuration in which there is one of open and short circuits between the connection terminal and the output terminal. Furthermore, PTL 1 fails also to disclose a lighting circuit to which a solid-state light-emitting element module having the stated configuration can be connected.

A lighting circuit, a luminaire, and an illumination system disclosed herein have been conceived to solve a problem such as that described above. An object of the present disclosure is to provide a lighting circuit, a luminaire, and an illumination system that are capable of supplying current to solid-state light-emitting element modules of multiple types.

In order to achieve the aforementioned object, a lighting circuit according to one aspect of the present disclosure is a lighting circuit which supplies current to a solid-state light-emitting element module including: a solid-state light-emitting element; a first connection terminal connected to one end of the solid-state light-emitting element; a third connection terminal connected to another end of the solid-state light-emitting element; and a second connection terminal, and the lighting circuit includes: a characteristics detector that detects one of open and short circuits between the third connection terminal and the second connection terminal; and a power controller that adjusts current that is supplied between the first connection terminal and the third connection terminal of the solid-state light-emitting element module, to a predetermined value greater than zero, when the characteristics detector detects one of the open and short circuits between the third connection terminal and the second connection terminal.

According to the present disclosure, it is possible to provide a lighting circuit, a luminaire, and an illumination system that are capable of supplying current to solid-state light-emitting element modules of multiple types.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE PREFERRED EMBODIMENTS

Hereinafter, exemplary embodiments are described with reference to the accompanying drawings. Note that each of the embodiments described below shows a preferred specific example of the present disclosure. Therefore, the numerical values, shapes, materials, structural elements, arrangement and connection of the structural elements, steps, the processing order of the steps etc., shown in the following embodiments are mere examples, and are not intended to limit the present disclosure. Consequently, among the structural elements in the following embodiments, structural elements not recited in any one of the independent claims which indicate the broadest concepts of the present disclosure are described as arbitrary structural elements.

Note that the respective figures are schematic diagrams and are not necessarily precise illustrations. Additionally, substantially the same structural elements in the figures share the same reference signs, and description that would overlap may be omitted or simplified.

Embodiment 1

1.1. Configuration of Illumination System

First, a configuration of an illumination system according to Embodiment 1 is described with reference to the drawings.

Figure 1:
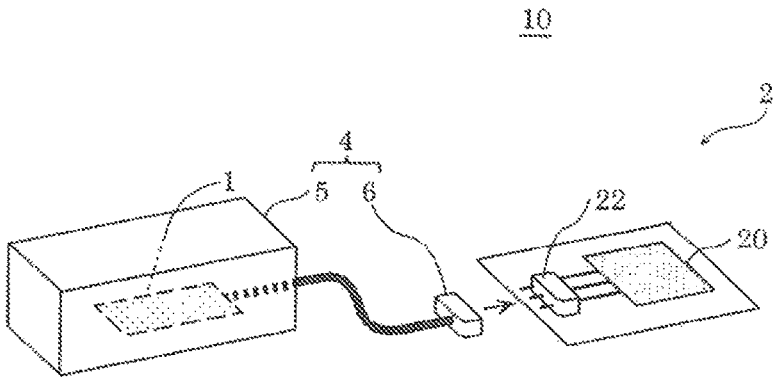
FIG. 1 is an external perspective view schematically illustrating an illumination system according to Embodiment 1.

FIG. 1 is an external perspective view schematically illustrating illumination system 10 according to this embodiment.

Figure 2:
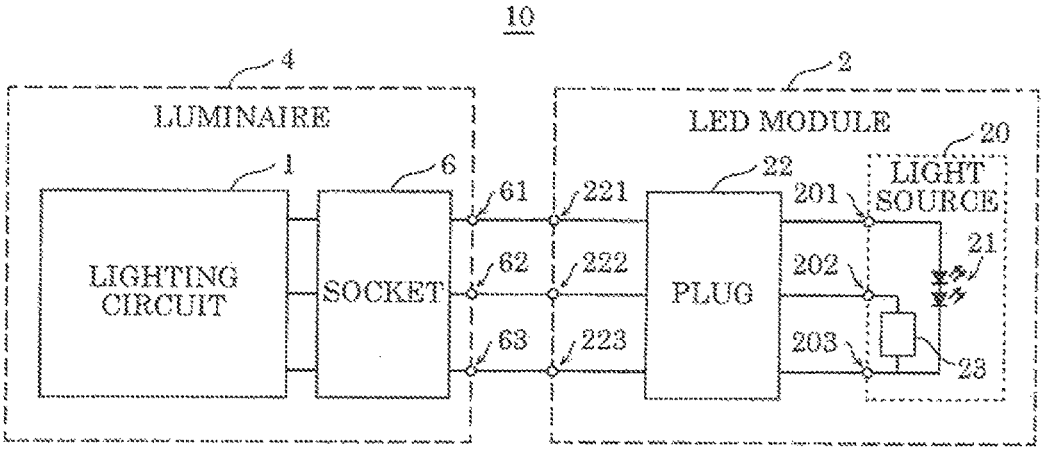
FIG. 2 is a schematic circuit diagram of an illumination system according to Embodiment 1.

FIG. 2 is a schematic circuit diagram of illumination system 10 according to this embodiment.

As illustrated in FIG. 1, illumination system 10 includes luminaire 4 and LED module 2.

Luminaire 4 is a device for supplying current to LED module 2, and includes power supply box 5 including lighting circuit 1, and socket 6.

LED module 2 is a solid-state light-emitting element module that emits light when supplied with current from luminaire 4. LED module 2 includes LED 21 which is a solid-state light-emitting element, first connection terminal 221 connected to one end of LED 21, third connection terminal 223 connected to the other end of LED 21, and second connection terminal 222. In this embodiment, LED module 2 includes plug 22 which is connected to socket 6 of luminaire 4, and light source 20 having LED 21.

As illustrated in FIG. 2, luminaire 4 according to this embodiment further includes output terminals 61 and 63 for supplying current to LED 21 of LED module 2, and output terminal 62 to which voltage for detecting electrical characteristics of LED module 2 is applied. In this embodiment, output terminals 61 and 63 and output terminal 62 are included in socket 6.

Lighting circuit 1 supplies current to LED module 2. Details of lighting circuit 1 are described later.

Socket 6 is a coupling part that is connected to plug 22 of LED module 2, and includes output terminals 61, 62, and 63. The shape, structure, etc., of socket 6 are not particularly limited as long as they are adapted to plug 22.

Plug 22 is a coupling part that is connected to socket 6 and light source 20, and includes first connection terminal 221, second connection terminal 222, and third connection terminal 223 as illustrated in FIG. 2. The shape, structure, etc., of plug 22 are not particularly limited as long as they are adapted to socket 6.

First connection terminal 221 is one of the terminals of plug 22 and is connected to an anode-side end of LED 21.

Second connection terminal 222 is one of the terminals of plug 22, and is connected to characteristics setter 23. Voltage for generating an identification signal is applied from luminaire 4 to second connection terminal 222.

Third connection terminal 223 is one of the terminals of plug 22 and is connected to a cathode-side end of LED 21.

First connection terminal 221, second connection terminal 222, and third connection terminal 223 are respectively connected to output terminals 61, 62, and 63 of socket 6.

Light source 20 is a light source of LED module 2, and includes LED 21, characteristics setter 23, connection terminals 201, 202, and 203, and a substrate (not illustrated in the drawings) on which these parts are provided. In this embodiment, the substrate is formed of a planar substrate.

LED 21 is a solid-state light-emitting element that is used as a light emitter of LED module 2. LED 21 is formed of a SMD (surface mount device) LED element, for example. Furthermore, LED 21 includes one or more LED elements.

Connection terminal 201 is connected to an anode side of LED 21. Connection terminal 201 is connected to high-voltage output terminal 61 of luminaire 4 via plug 22.

Connection terminal 202 is connected to characteristics setter 23. Connection terminal 202 is connected to output terminal 62 of luminaire 4 via plug 22.

Connection terminal 203 is connected to a cathode side of LED 21. Connection terminal 203 is connected to low-voltage output terminal 63 of luminaire 4 via plug 22.

Characteristics setter 23 is a circuit connected between connection terminal 202 and connection terminal 203 and to which voltage for generating an identification signal is applied from luminaire 4. Characteristics setter 23 is also referred to as an identification resistor. In this embodiment, characteristics setter 23 is configured to create an open or short circuit between connection terminal 202 and connection terminal 203, or is configured so as to connect connection terminal 202 and connection terminal 203 to each other via a resistor or the like. Hereinafter, each of the above-stated configurations is described.

First, a configuration in which there is an open circuit between connection terminal 202 and connection terminal 203 is described with reference to FIG. 3 and FIG. 4.

Figure 3:
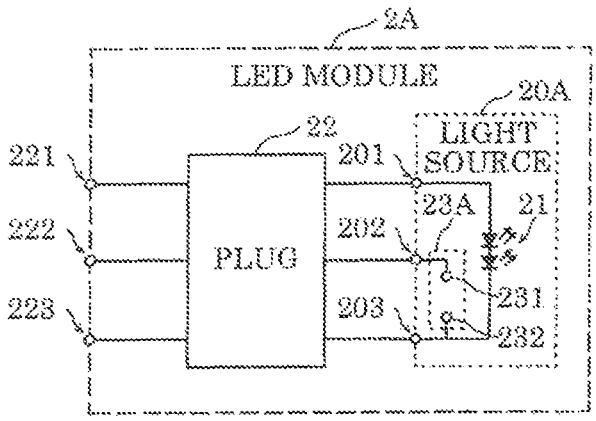
FIG. 3 is a circuit diagram illustrating one example of a configuration of an LED module according to Embodiment 1.

FIG. 3 is a circuit diagram illustrating one example of a configuration of LED module 2A according to this embodiment.

As illustrated in FIG. 3, in characteristics setter 23A in light source 20A of LED module 2A, there is an open circuit between terminal 231 connected to connection terminal 202 and terminal 232 connected to connection terminal 203. Accordingly, there is likewise an open circuit between second connection terminal 222 and third connection terminal 223 as well.

Next, another configuration in which there is an open circuit between connection terminal 202 and connection terminal 203 is described with reference to FIG. 4.

Figure 4:
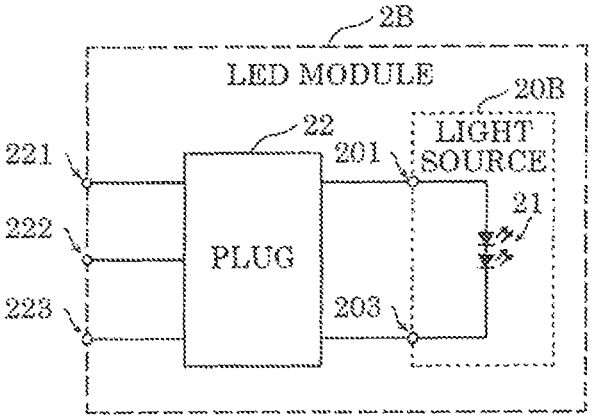
FIG. 4 is a circuit diagram illustrating one example of a configuration of an LED module according to Embodiment 1.

FIG. 4 is a circuit diagram illustrating one example of a configuration of LED module 2B according to this embodiment. Light source 20B of LED module 2B illustrated in FIG. 4 is configured not to include characteristics setter 23 and connection terminal 202.

As illustrated in FIG. 4, also in LED module 2B, there is an open circuit between second connection terminal 222 and third connection terminal 223 as in the case of LED module 2A described above. Although FIG. 4 illustrates the configuration of LED module 2B in which characteristics setter 23 and connection terminal 202 are not included, LED module 2B may be configured not to include characteristics setter 23, but to include connection terminal 202.

Next, a configuration in which there is a short circuit between connection terminal 202 and connection terminal 203 is described with reference to FIG. 5.

Figure 5:
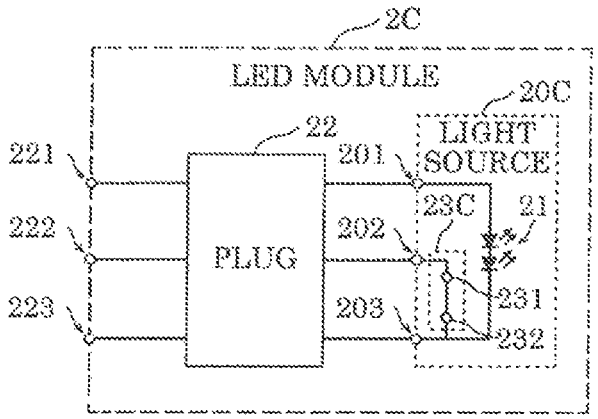
FIG. 5 is a circuit diagram illustrating one example of a configuration of an LED module according to Embodiment 1.

FIG. 5 is a circuit diagram illustrating one example of a configuration of LED module 2C according to this embodiment.

As illustrated in FIG. 5, in characteristics setter 23C in light source 20C of LED module 2C, there is a short circuit between terminal 231 connected to connection terminal 202 and terminal 232 connected to connection terminal 203. Note that a configuration of connection between connection terminal 202 and connection terminal 203 is not limited to the example illustrated in FIG. 5; any connection that can reduce electrical resistance between connection terminal 202 and connection terminal 203 to a sufficiently low level may be adopted.

Next, a configuration in which connection terminal 202 and connection terminal 203 are connected to each other via a resistor is described with reference to FIG. 6.

Figure 6:
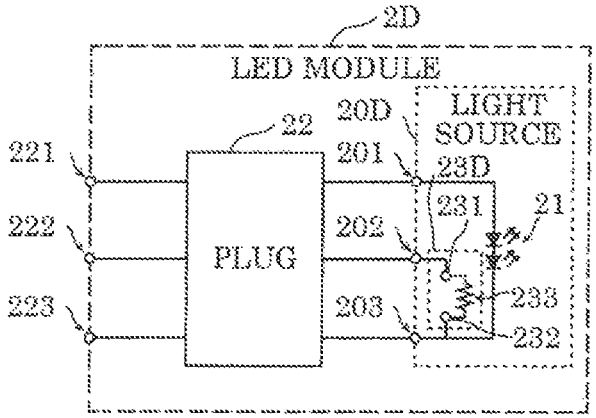
FIG. 6 is a circuit diagram illustrating one example of a configuration of an LED module according to Embodiment 1.

FIG. 6 is a circuit diagram illustrating one example of a configuration of LED module 2D according to this embodiment.

As illustrated in FIG. 6, in characteristics setter 23D in light source 20D of LED module 2D, terminal 231 connected to connection terminal 202 and terminal 232 connected to connection terminal 203 are connected to each other via resistor 233. In light source 20D, as a result of providing a connection between connection terminal 202 and connection terminal 203 with use of resistor 233 having a resistance value corresponding to electrical characteristics of LED 21, an identification signal corresponding to the electrical characteristics can be generated.

As will be described later, lighting circuit 1 according to this embodiment is capable of supplying an LED module of any of the types of LED modules 2A to 2D described above, with current adapted to electrical characteristics of the LED module.

1-2. Configuration of Lighting Circuit

Next, a configuration of lighting circuit 1 according to this embodiment is described with reference to the drawings.

Figure 7:
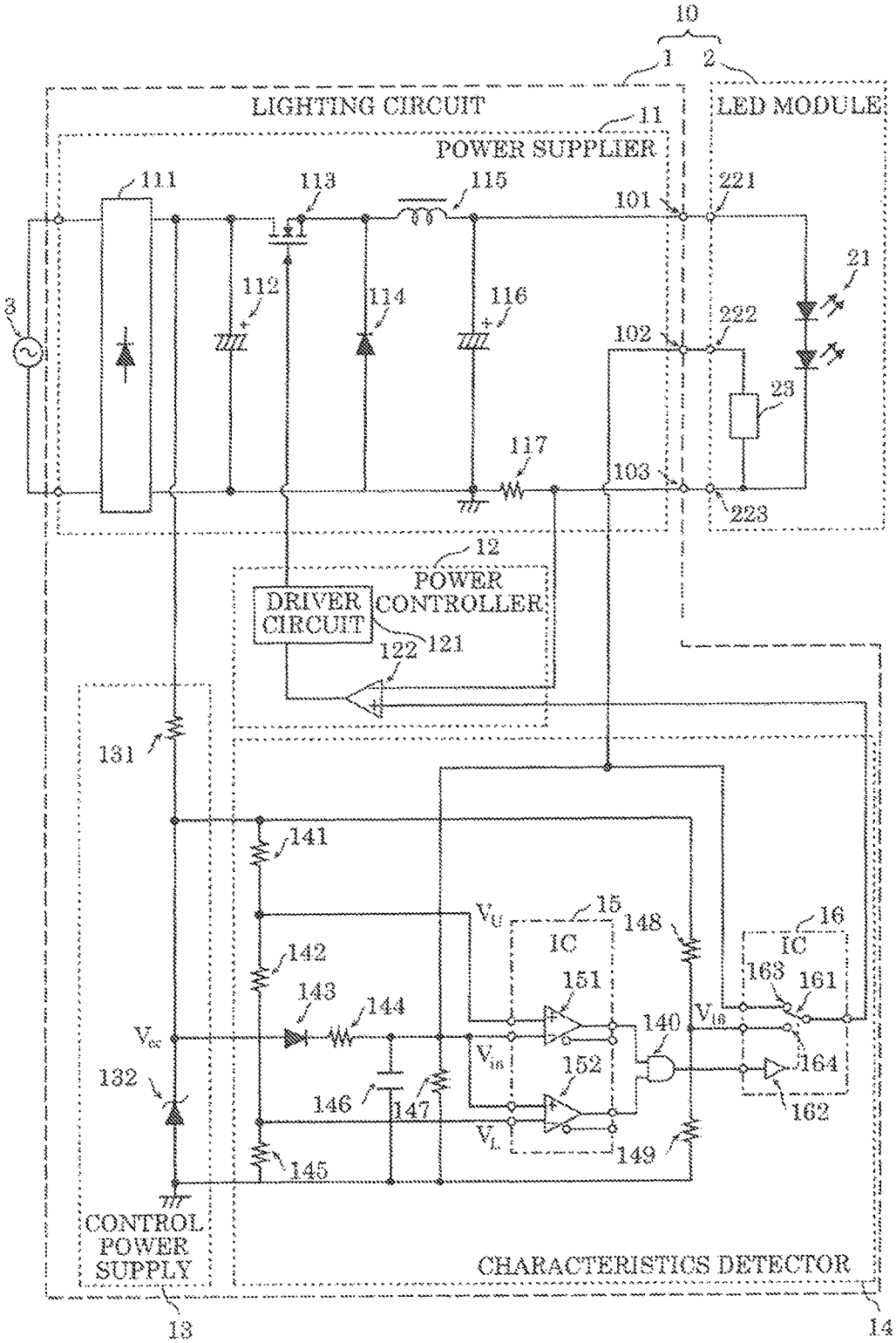
FIG. 7 is a circuit diagram illustrating a configuration of a lighting circuit according to Embodiment 1.

FIG. 7 is a circuit diagram illustrating a configuration of lighting circuit 1 according to this embodiment. FIG. 7 illustrates lighting circuit 1, illumination system 10 including lighting circuit 1, and AC (alternating-current) power supply 3 which supplies electrical power to lighting circuit 1.

AC power supply 3 outputs AC voltage and is a system power supply such as a commercial power supply which outputs AC voltage of 100 V to 242 V, for example.

As illustrated in FIG. 7, lighting circuit 1 includes power supplier 11, power controller 12, control power supply 13, and characteristics detector 14. Furthermore, lighting circuit 1 includes output terminals 101, 102, and 103.

Output terminals 101 and 103 are terminals that are respectively electrically connected to first connection terminal 221 and third connection terminal 223 of LED module 2 and from which current is output to LED module 2.

Output terminal 102 is electrically connected to second connection terminal 222 of LED module 2 and applies to second connection terminal 222 voltage for generating an identification signal.

Power supplier 11 is a circuit that supplies constant DC (direct current) to LED module 2. In this embodiment, power supplier 11 converts to DC voltage AC voltage input from AC power supply 3, and additionally performs DC-to-DC conversion, thereby generating constant DC. As illustrated in FIG. 7, power supplier 11 includes rectifier 111, capacitors 112 and 116, switching element 113, diode 114, inductor 115, and resistor 117.

Rectifier 111 is a circuit that rectifies AC voltage input from AC power supply 3. Rectifier 111 includes a diode bridge, for example.

Capacitor 112 is an element that is connected to an output terminal of rectifier 111 and is used for smoothing pulsing DC voltage output from rectifier 111. Furthermore, a series circuit including switching element 113 and diode 114 is connected to both ends of capacitor 112. In this embodiment, capacitor 112 is formed of an electrolytic capacitor.

Switching element 113 is an element that performs a switching operation (repeats turning ON and OFF) under control of power controller 12; in this embodiment, switching element 113 is an N-channel MOSFET (metal-oxide semiconductor field-effect transistor) connected in series with inductor 115.

Diode 114 is a rectifying element that forms a closed circuit together with LED 21 in LED module 2 and inductor 115 and recovers energy stored in inductor 115. A cathode terminal of diode 114 is connected to a connection point between switching element 113 and inductor 115, and an anode terminal of diode 114 is connected to a low-voltage output terminal of rectifier 111. Furthermore, a series circuit including inductor 115 and capacitor 116 is connected to both ends of diode 114.

Inductor 115 is a choke coil, and stores and releases energy according to a switching operation of switching element 113.

Capacitor 116 is an element that is connected in parallel with LED 21 and smoothes pulsating voltage that occurs at inductor 115, etc. In this embodiment, capacitor 116 is formed of an electrolytic capacitor.

Resistor 117 is a sense resistor connected in series with LED 21 and used for detecting current that flows to LED 21, that is, an output current of power supplier 11.

Power controller 12 is a circuit that detects an output current of power supplier 11 by detecting voltage that is applied to resistor 117 of power supplier 11, and performs, based on the detected output current, feedback control on the output current of power supplier 11. As illustrated in FIG. 7, power controller 12 includes driver circuit 121 and comparator 122. In this embodiment, power controller 12 adjusts current that is supplied to LED module 2, to a predetermined value greater than zero, when characteristics detector 14 detects one of open and short circuits between third connection terminal 223 and second connection terminal 222. Power controller 12 adjusts current that is supplied to LED module 2, based on a value of resistance between third connection terminal 223 and second connection terminal 222, when characteristics setter 14 detects neither of the open and short circuits between third connection terminal 223 and second connection terminal 222.

Driver circuit 121 performs control of causing switching element 113 to repeat turning ON and OFF (i.e., perform a switching operation). The control by driver circuit 121 allows the output current of power supplier 11 to be maintained substantially constant.

Comparator 122 is a circuit that compares voltage corresponding to the output current of power supplier 11 with voltage corresponding to a target value of the output current that is input from characteristics detector 14. Voltage that is applied to resistor 117 of power supplier 11 is input to an inverting input terminal of comparator 122. Voltage corresponding to a target value of the output current of power supplier 11 is input from characteristics detector 14 to a non-inverting input terminal of comparator 122. An output of comparator 122 is input to driver circuit 121.

Control power supply 13 is a circuit that applies constant voltage $V_{cc}$ to characteristics detector 14. As illustrated in FIG. 7, control power supply 13 includes resistor 131 and Zener diode 132.

Resistor 131 is an element for limiting current that flows to Zener diode 132.

Zener diode 132 is an element for stabilizing voltage that is applied to characteristics detector 14. Voltage that is applied across Zener diode 132 is approximately 15 V, for example.

Characteristics detector 14 is a circuit that detects, based on the identification signal, one of open and short circuits between third connection terminal 223 and second connection terminal 222 of LED module 2. Characteristics detector 14 outputs to power controller 12 voltage determined based on the result of the detection. This voltage corresponds to a target value of current which power supplier 11 outputs. As illustrated in FIG. 7, characteristic detector 14 includes ICs (integrated circuits) 15 and 16, resistors 141, 142, 145, 147, 148, and 149, diode 143, capacitor 146, and AND circuit 140.

IC 15 is a circuit for detecting voltage $V_{in}$, of the identification signal (that is, voltage at second connection terminal 222 of LED module 2). IC 15 includes comparators 151 and 152, and compares voltage $V_{in}$ of the identification signal with high-voltage reference voltage $V_U$ and low-voltage reference voltage $V_L$. When voltage $V_{in}$ of the identification signal is higher than reference voltage $V_U$, characteristics detector 14 determines that there is an open circuit between second connection terminal 222 and third connection terminal 223 of LED module 2. When voltage $V_{in}$ of the identification signal is lower than reference voltage $V_L$, characteristics detector 14 determines that there is a short circuit between second connection terminal 222 and third connection terminal 223 of LED module 2.

Comparator 151 is a circuit that compares voltage $V_{in}$ of the identification signal and high-voltage reference voltage $V_U$. Reference voltage $V_U$ and voltage $V_{in}$ of the identification signal are respectively input to a non-inverting input terminal and an inverting input terminal of comparator 151.

Comparator 152 is a circuit that compares voltage $V_{in}$ of the identification signal and low-voltage reference voltage $V_L$. Voltage $V_{in}$ of the identification signal and reference voltage $V_L$ are respectively input to a non-inverting input terminal and an inverting input terminal of comparator 152.

Resistors 141, 142, and 145 are elements among which voltage applied by control power supply 13 is divided and that are used for generating high-voltage reference voltage $V_U$ and low-voltage reference voltage $V_L$. Resisters 141, 142, and 145 are connected in series in the stated order and are connected to an output end of control power supply 13. Accordingly, high-voltage reference voltage $V_U$ is generated at a connection point between resistor 141 and resistor 142, and low-voltage reference voltage $V_L$ is generated at a connection point between resistor 142 and resistor 145. The connection point between resistor 141 and resistor 142 is connected to the non-inverting input terminal of comparator 151, and the connection point between resistor 142 and resistor 145 is connected to the non-inverting input terminal of comparator 152.

Diode 143 is a rectifying element for preventing current from flowing toward control power supply 13.

Resistors 144 and 147 are elements among which voltage applied by control power supply 13 is divided. A connection point between resistor 144 and resistor 147 is connected to second connection terminal 222 of LED module 2. Thus, voltage $V_{in}$ of the identification signal is applied to this connection point. Resistance value $R_{147}$ of resistor 147 is set to a value sufficiently greater than resistance value $R_{144}$ of resistor 144 and resistance value $R_{233}$ of resistor 233 which is used in characteristics setter 23 of LED module 2. For example, when resistance values $R_{144}$ and $R_{233}$ are approximately 1 kΩ to several tens of kilo-ohms, resistance value $R_{147}$ is approximately several tens of mega-ohms. How to determine resistance values $R_{144}$ and $R_{233}$ will be described later in detail.

Capacitor 146 is an element for reducing noise that is added to the identification signal.

Resistors 148 and 149 are elements among which voltage applied by control power supply 13 is divided and that are used for generating reference voltage $V_{16}$ that is input to IC 16. Reference voltage $V_{16}$ corresponds to a target value of current that is supplied to LED module 2 when there is one of open and short circuits between second connection terminal 222 and third connection terminal 223 of LED module 2.

AND circuit 140 receives, as an input, output from comparators 151 and 152 of IC 15, and outputs a signal corresponding to a logical conjunction of the input. Since input signals for comparators 151 and 152 are set as described above, AND circuit 140 outputs a HIGH signal when voltage $V_{in}$ of the identification signal is higher than reference voltage $V_U$ or when voltage $V_{in}$ of the identification signal is lower than reference voltage $V_L$. When voltage $V_{in}$ of the identification signal is higher than reference voltage $V_L$ and lower than reference voltage $V_U$, AND circuit 140 outputs a LOW signal.

IC 16 is a circuit that determines a target value of the output current of power supplier 11 based on a signal output from AND circuit 140, and includes changeover switch 161 and buffer circuit 162.

Changeover switch 161 is an element that connects an output terminal and terminal 163 or 164 of IC 16.

Buffer circuit 162 is for shaping a waveform of an output signal of AND circuit 140.

IC 16 has the aforementioned configuration and therefore operates as follows. Changeover switch 161 is connected to terminal 164 when AND circuit 140 outputs a HIGH signal, that is, when voltage $V_{in}$ of the identification signal is higher than reference voltage $V_U$ or when voltage $V_{in}$ of the identification signal is lower than reference voltage $V_L$. With this, IC 16 outputs reference voltage $V_{16}$. Changeover switch 161 is connected to terminal 163 when AND circuit 140 outputs a LOW signal, that is, when voltage $V_{in}$ of the identification signal is higher than reference voltage $V_L$ and lower than reference voltage $V_U$. With this, IC 16 outputs voltage $V_{in}$ of the identification signal.

With lighting circuit 1 configured as described above, voltage $V_{in}$ of the identification signal is determined as follows according to the configuration of characteristics setter 23 of LED module 2, that is, the configuration of connection between second connection terminal 222 and third connection terminal 223.

Voltage $V_{in}$ of the identification signal is represented by Expression 1 below when there is an open circuit between second connection terminal 222 and third connection terminal 223.

$$V_{in}=V_{cc}\times R_{147}/(R_{144}+R_{147}) \quad \text{Expression 1}$$

Since resistance value $R_{147}$ is sufficiently greater than resistance value $R_{144}$, voltage $V_{in}$ is substantially equal to voltage $V_{cc}$. Resistance values $R_{144}$ and $R_{147}$ and resistance values of resistors 141, 142, and 145 are determined in such a way that voltage $V_{in}$ of the identification signal represented by Expression 1 is higher than high-voltage reference voltage $V_U$. Accordingly, it is possible to determine that there is an open circuit between second connection terminal 222 and third connection terminal 223 when voltage $V_{in}$ of the identification signal is higher than high-voltage reference voltage $V_U$.

When there is a short circuit between second connection terminal 222 and third connection terminal 223 of LED module 2, third connection terminal 223 is grounded via resistor 117 having a sufficiently small resistance value, and therefore voltage $V_{in}$ of the identification signal is substantially zero. Resistance values of resistors 117, 141, 142, and 145 are determined in such a way that voltage $V_{in}$ of the identification signal is lower than low-voltage reference voltage $V_L$. Accordingly, it is possible to determine that there is a short circuit between second connection terminal 222 and third connection terminal 223 when voltage $V_{in}$ of the identification signal is lower than low-voltage reference voltage $V_L$.

With reference to the drawings, the following describes a case where second connection terminal 222 and third connection terminal 223 of LED module 2 are connected to each other via resistor 233 having resistance value $R_{233}$.

Figure 8:
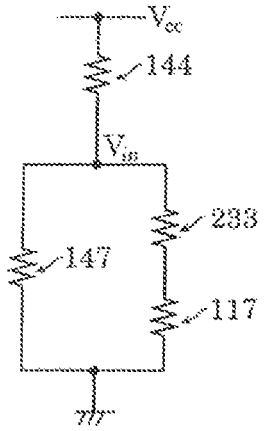
FIG. 8 is an equivalent circuit schematic of a circuit that determines voltage of an identification signal according to Embodiment 1.

FIG. 8 is an equivalent circuit schematic of a circuit that determines voltage $V_{in}$ of the identification signal according to this embodiment.

As illustrated in FIG. 8, a series circuit including resistor 233 and resistor 117 is connected to resistor 147 in parallel. In the equivalent circuit schematic illustrated in FIG. 8, resistance value $R_{117}$ of resistor 117 is sufficiently smaller than resistance value $R_{233}$, and therefore resistor 117 can be ignored. Furthermore, resistance value $R_{147}$ is sufficiently larger than resistance value $R_{233}$, and therefore, combined resistance of a circuit including resistors 147, 233, and 117 is substantially equal to resistance value $R_{233}$. Accordingly, voltage $V_{in}$ of the identification signal is represented by Expression 2 below.

$$V_{in}=V_{cc}\times R_{233}/(R_{144}+R_{233}) \quad \text{Expression 2}$$

Resistance values $R_{233}$ and $R_{144}$ and resistance values of resistors 141, 142, and 145 are determined in such a way that voltage $V_{in}$ of the identification signal represented by Expression 2 is higher than low-voltage reference voltage $V_L$ and lower than high-voltage reference voltage $V_U$. Accordingly, it is possible to determine that resistor 233 is connected to characteristics setter 23 when voltage $V_{in}$ of the identification signal is higher than low-voltage reference voltage $V_L$ and lower than high-voltage reference voltage $V_U$. When it is determined that resistor 233 is connected to characteristics setter 23, voltage $V_{in}$ of the identification signal represented by above Expression 2 is input to power controller 12 as described above. Furthermore, feedback control is performed on the output current of lighting circuit 1 based on voltage $V_{in}$ of the identification signal input to power controller 12; therefore, in this embodiment, power controller 12 increases current that is supplied to LED module 2 as resistance value $R_{233}$ increases.

As described above, characteristics detector 14 detects a configuration of connection between second connection terminal 222 and third connection terminal 223, using the identification signal that corresponds to a value of resistance between second connection terminal 222 and third connection terminal 223.

With this, when second connection terminal 222 and third connection terminal 223 of LED module 2 are connected to each other via resistor 233, lighting circuit 1 is capable of supplying LED module 2 with current corresponding to resistance value $R_{233}$ of resistor 233. Furthermore, when there is one of open and short circuits between second connection terminal 222 and third connection terminal 223 of LED module 2, lighting circuit 1 is capable of supplying LED module 2 with a predetermined current (that is, current corresponding to reference voltage $V_{16}$) as well. Note that the predetermined current can be appropriately determined according to the electrical characteristics of LED module 2 that is connectable to lighting circuit 1.

1-3. Operation Performed by Lighting Circuit

Next, an operation performed by lighting circuit 1 is described with reference to the drawings.

Figure 9:
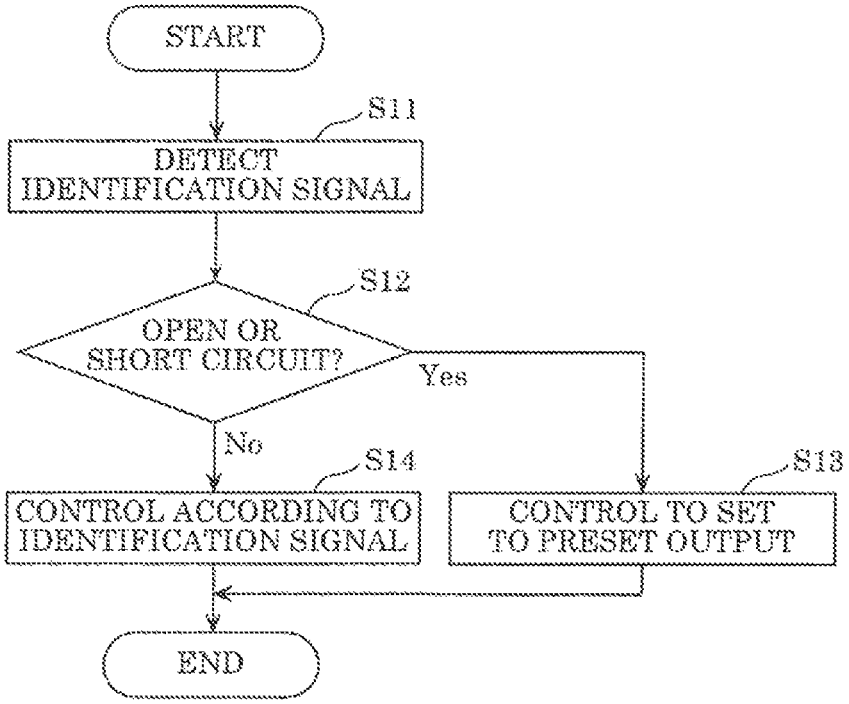
FIG. 9 is a flowchart showing an operation performed by a lighting circuit according to Embodiment 1.

FIG. 9 is a flowchart showing an operation performed by lighting circuit 1 according to this embodiment.

As illustrated in FIG. 9, first, characteristics detector 14 of lighting circuit 1 applies voltage to second connection terminal 222 of LED module 2 and detects $V_{in}$ of the identification signal (S11).

Next, characteristics detector 14 compares voltage $V_{in}$ of the identification signal with reference voltage $V_U$ and reference voltage $V_L$, to determine whether (i) there is one of open and short circuits between second connection terminal 222 and third connection terminal 223 or (ii) second connection terminal 222 and third connection terminal 223 are connected to each other via resistor 233 (S12).

When characteristics detector 14 determines that there is one of open and short circuits between second connection terminal 222 and third connection terminal 223 (Yes in S12), lighting circuit 1 controls power supplier 11 so that output of power supplier 11 is a preset output that has been predetermined (S13). Specifically, lighting circuit 1 inputs reference voltage $V_{16}$ that corresponds to the present output, from characteristics detector 14 to power controller 12, to perform such feedback control that voltage corresponding to the output current of power supplier 11 is substantially equal to reference voltage $V_{16}$.

On the other hand, when characteristics detector 14 determines that second connection terminal 222 and third connection terminal 223 are connected to each other via resistor 233 (No in S12), lighting circuit 1 controls the output current of power supplier 11 according to the identification information (S14). Specifically, lighting circuit 1 inputs voltage $V_{in}$ of the identification signal from characteristics detector 14 to power controller 12, to perform such feedback control that voltage corresponding to the output current of power supplier 11 is substantially equal to voltage $V_{in}$.

As described above, lighting circuit 1 according to this embodiment supplies LED module 2 with current determined based on the configuration between second connection terminal 222 and third connection terminal 223 of LED module 2, that is, the configuration of characteristics setter 23.

1-4. Advantageous Effects, Etc.

As described above, lighting circuit 1 according to this embodiment includes characteristics setter 14 that detects one of open and short circuits between third connection terminal 223 and second connection terminal 222 of LED module 2. Furthermore, lighting circuit 1 includes power controller 12 that adjusts current that is supplied to LED module 2, to a predetermined value greater than zero, when characteristics detector 14 detects one of open and short circuits between third connection terminal 223 and second connection terminal 222.

With this, lighting circuit 1 is capable of supplying current to LED module 2 of a type in which there is one of open and short circuits between second connection terminal 222 and third connection terminal 223.

In lighting circuit 1 according to this embodiment, characteristics detector 14 may detect one of open and short circuits between third connection terminal 223 and second connection terminal 222 by measuring a value of resistance between third connection terminal 223 and second connection terminal 222.

Furthermore, in lighting circuit 1 according to this embodiment, when characteristics detector 14 detects neither of the open and short circuits between third connection terminal 223 and second connection terminal 222, power controller 12 adjusts, based on resistance value $R_{233}$, current that is supplied to LED module 2.

Thus, lighting circuit 1 is capable of supplying current to LED module 2 of a type in which third connection terminal 223 and second connection terminal 222 are connected to each other via a resistor. Furthermore, lighting circuit 1 is capable of adjusting, according to the resistor, current that is supplied to LED module 2, and therefore is capable of supplying current to LED module 2 of various types the required current of which is different.

Furthermore, in lighting circuit 1 according to this embodiment, power controller 12 may increase the current that is supplied to LED module 2 as the value of resistance between third connection terminal 223 and second connection terminal 222 increases.

Embodiment 2

Next, a lighting circuit according to Embodiment 2 is described. The lighting circuit according to this embodiment includes, in addition to the functions of lighting circuit 1 according to Embodiment 1 described above, a function of determining whether or not LED module 2 is connected.

The following description will focus on the configuration of the lighting circuit according to this embodiment that is different from that of lighting circuit 1 according to Embodiment 1 described above; as such, description of configurations common to these embodiments will be omitted.

2-1. Configuration of Lighting Circuit

First, a configuration of a lighting circuit and a configuration of an illumination system including the lighting circuit according to this embodiment are described with reference to the drawings.

Figure 10:
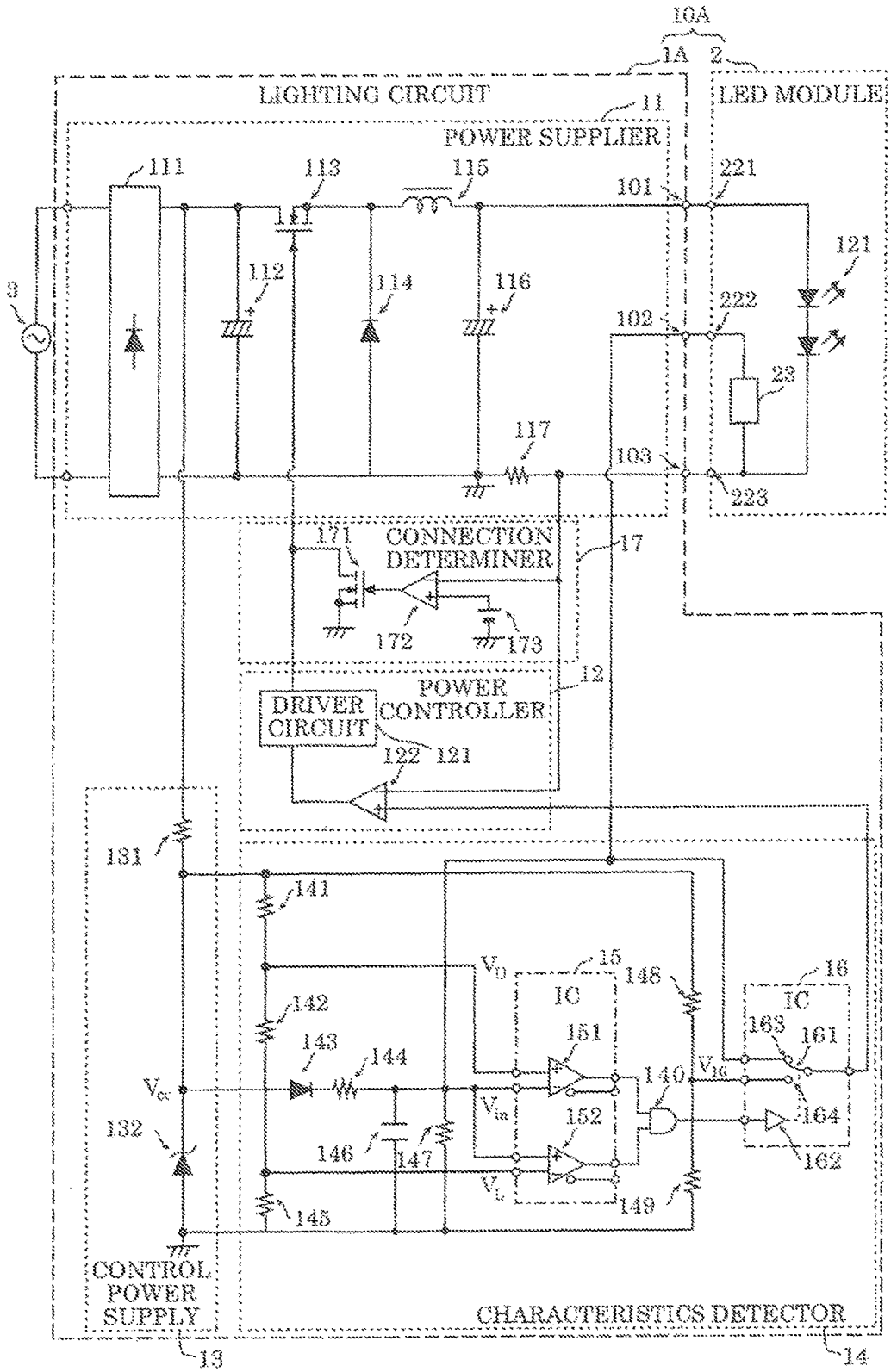
FIG. 10 is a circuit diagram illustrating a configuration of a lighting circuit according to Embodiment 2.

FIG. 10 is a circuit diagram illustrating a configuration of lighting circuit 1A according to this embodiment. FIG. 10 illustrates lighting circuit 1A, illumination system 10A including lighting circuit 1A, and AC power supply 3 which supplies electrical power to lighting circuit 1A.

As illustrated in FIG. 10, lighting circuit 1A not only includes power supplier 11, power controller 12, control power supply 13, and characteristics detector 14 as does lighting circuit 1 according to Embodiment 1 described above, but also includes connection determiner 17.

Connection determiner 17 is a circuit that determines whether or not LED module 2 is connected to lighting circuit 1A. When LED module 2 is connected to lighting circuit 1A, current flows to resistor 117, and connection determiner 17 senses, using voltage application across resistor 117, that LED module 2 is connected. When connection determiner 17 detects voltage application to resistor 117, connection determiner 17 does not influence an operation performed by switching element 113 of power supplier 11, and when connection determiner 17 does not detect voltage application to resistor 117, connection determiner 17 maintains switching element 113 in OFF state. Thus, connection determiner 17 deactivates power supplier 11. Connection determiner 17 includes switching element 171, comparator 172, and DC power supply 173.

DC power supply 173 generates a reference voltage for use in comparison with voltage that is applied to resistor 117. An output voltage of DC power supply 173 is input to a non-inverting input terminal of comparator 172. The output voltage of DC power supply 173 is determined based on resistance value $R_{117}$ of resistor 117 and current flowing when LED module 2 is properly connected to lighting circuit 1A. Specifically, the output voltage of DC power supply 173 is set to a value smaller than that of voltage applied to resistor 117 when LED module 2 is properly connected to lighting circuit 1A. The output voltage of DC power supply 173 is not particularly limited; for example, it is approximately 0.3 V.

Comparator 172 is a circuit that compares the output voltage of DC power supply 173 and voltage that is applied to resistor 117. An output voltage of DC power supply 173 and voltage that is applied to resistor 117 are respectively input to a non-inverting input terminal and an inverting input terminal of comparator 172. With this, when the output voltage of DC power supply 173 is higher than voltage that is applied to resistor 117, that is, when LED module 2 is not connected to lighting circuit 1A, comparator 172 outputs a HIGH signal to switching element 171. When the output voltage of DC power supply 173 is lower than voltage that is applied to resistor 117, that is, when LED module 2 is connected to lighting circuit 1A, comparator 172 outputs a LOW signal to switching element 171.

Switching element 171 deactivates power supplier 11 when LED module 2 is not connected to lighting circuit 1A. In this embodiment, switching element 171 is an N-channel MOSFET. When it is determined based on an output signal of comparator 172 that LED module 2 is not connected to lighting circuit 1A, switching element 171 causes a gate electrode of switching element 113 of power supplier 11 to be grounded so that power supplier 11 is deactivated. When it is determined based on an output signal of comparator 172 that LED module 2 is connected to lighting circuit 1A, switching element 171 opens a circuit between the gate electrode of switching element 113 and a grounded source electrode of switching element 171. Thus, switching element 171 does not influence an operation performed by power supplier 11 when it is determined that LED module 2 is connected to lighting circuit 1A.

As described above, lighting circuit 1A according to this embodiment has a configuration that can determine whether or not LED module 2 is connected.

2-2. Operation Performed by Lighting Circuit

Next, an operation performed by lighting circuit 1A is described with reference to the drawings.

Figure 11:
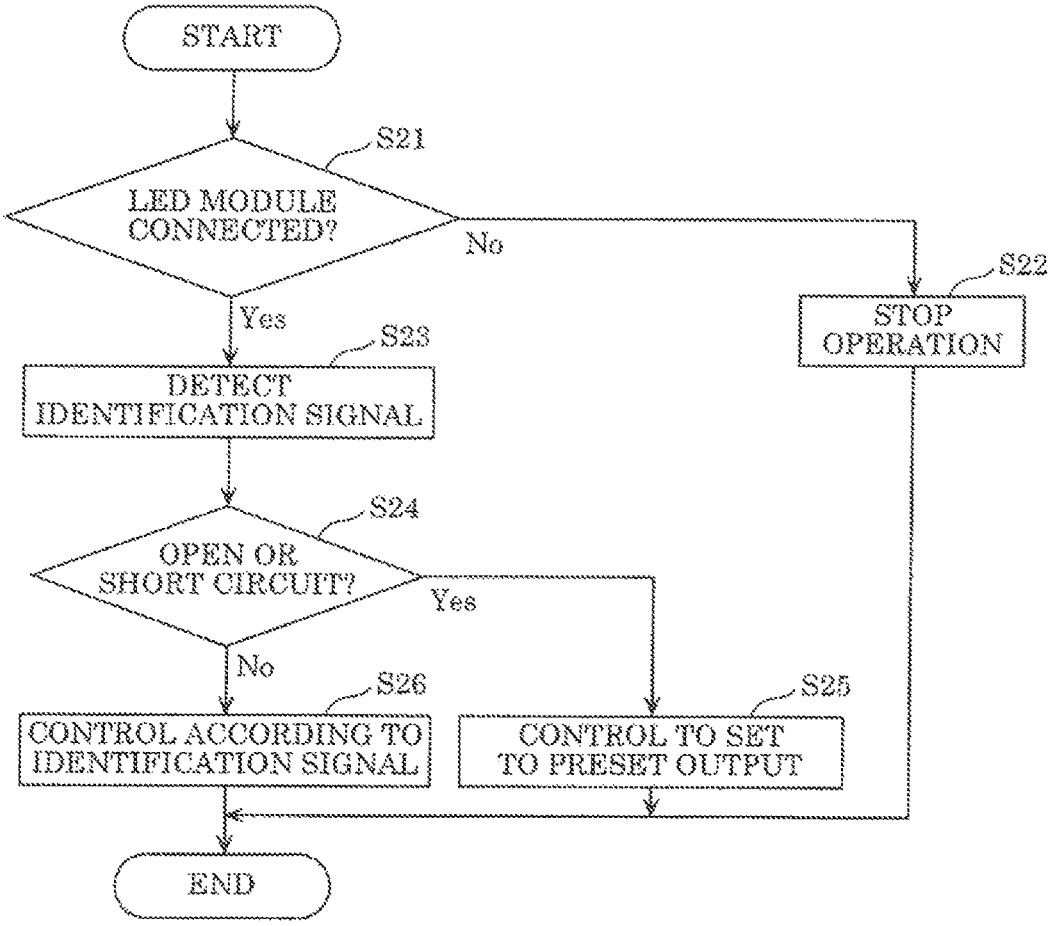
FIG. 11 is a flowchart showing an operation performed by a lighting circuit according to Embodiment 2.

FIG. 11 is a flowchart showing an operation performed by lighting circuit 1A according to this embodiment.

As illustrated in FIG. 11, first, connection determiner 17 of lighting circuit 1A determines whether or not LED module 2 is connected (S21).

When connection determiner 17 determines that LED module 2 is not connected to lighting circuit 1A (No in S21), power supplier 11 is deactivated, with the result that current output from lighting circuit 1A stops (S22).

When connection determiner 17 determines that LED module 2 is connected to lighting circuit 1A (Yes in S21), power supplier 11 is not deactivated, and an identification signal is detected (S23).

Steps following Step S23 of detecting an identification signal, namely, Steps S24, S25, and S26, are the same or similar as Steps S12, S13, and S14 in the operation performed by lighting circuit 1 according to Embodiment 1 described above.

After determining as described above whether or not LED module 2 is connected, lighting circuit 1A according to this embodiment supplies LED module 2 with current determined based on the configuration of characteristics setter 23 of LED module 2.

2-3. Advantageous Effects, Etc.

As described above, as compared to lighting circuit 1 according to Embodiment 1 described above, lighting circuit 1A according to this embodiment additionally includes connection determiner 17 that determines whether or not LED module 2 is connected to lighting circuit 1A, and when it is determined that LED module 2 is not connected, deactivates lighting circuit 1A.

Thus, lighting circuit 1A is deactivated when it is determined that LED module 2 is not connected, which reduces the occurrence of current being output during when LED module 2 is not connected.

Embodiment 3

Next, a lighting circuit, a luminaire, and an illumination system according to Embodiment 3 are described.

PTL 1 mentioned above discloses, regarding the LED module, a method of controlling a preset current value according to identification information on a lamp. However, the preset current value is controlled so as to have a directly proportional relationship with a voltage value of a connection terminal (that is, a value proportional to a resistance value of the characteristics setter). Even when the preset current value is controlled stepwise, the proportional relationship is basically maintained, that is, the preset current value is controlled so as to increase stepwise at a constant rate as the resistance value of the characteristics setter increases.

Such a control has a problem in that output of LED keeps on increasing and becomes high when the temperature of a resistor increases as a result of, for example, the LED module or a COB (chip on board) being in an abnormal condition due to an increase in ambient temperature or depending on a lighting status.

This embodiment aims to solve the aforementioned problem and provide a lighting circuit, a luminaire, and an illumination system that are capable of outputting proper light even in an abnormal state.

3-1. Configuration of Lighting Circuit

First, a configuration of lighting circuit 1B according to this embodiment is described with reference to the drawings.

Figure 12:
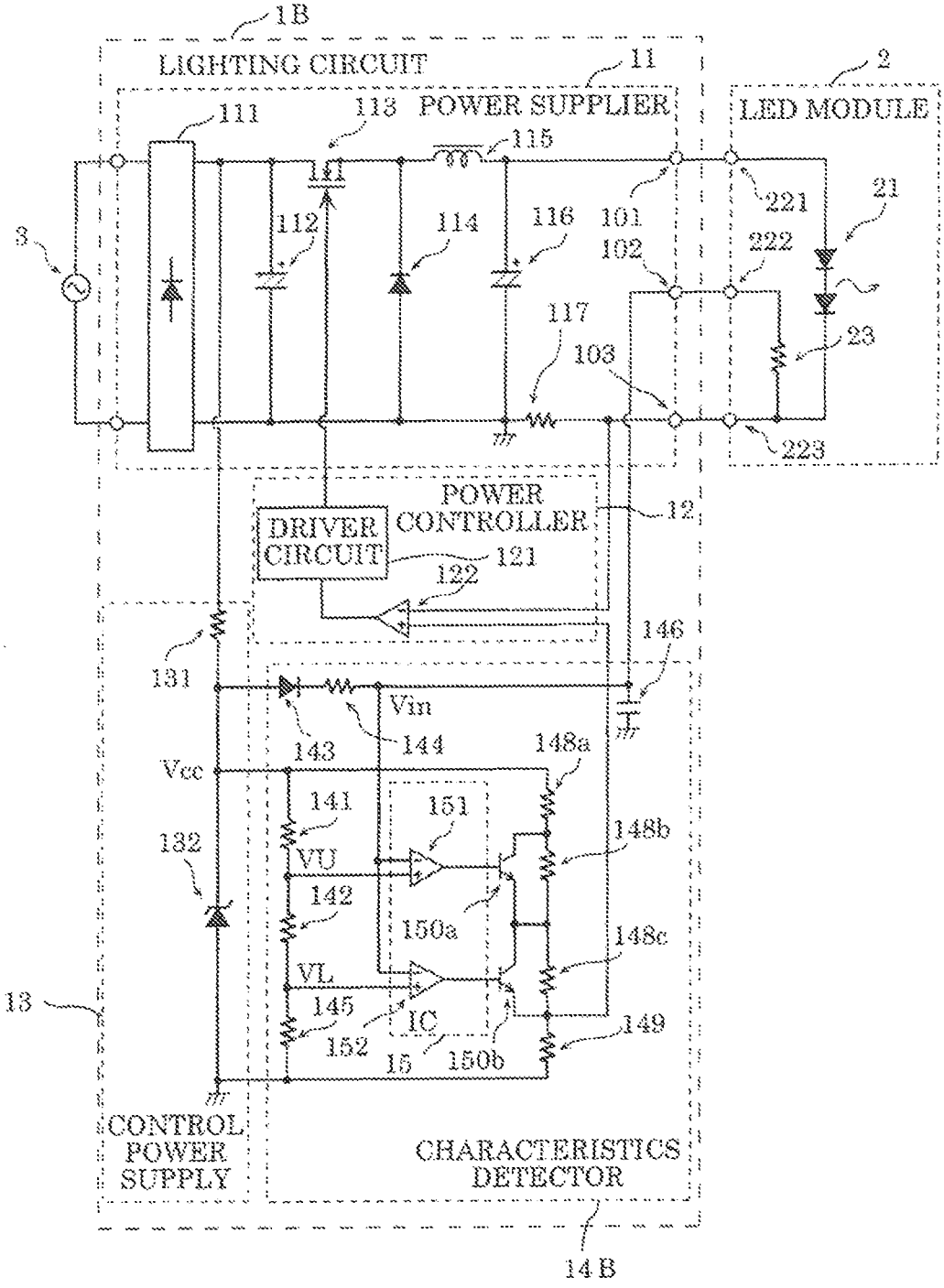
FIG. 12 is a schematic view of a lighting circuit with an LED module according to Embodiment 3.

FIG. 12 is a circuit diagram illustrating a configuration of lighting circuit 1B according to this embodiment. In addition to lighting circuit 1B, LED module 2 and AC power supply 3 which supplies electrical power to lighting circuit 1B are illustrated in FIG. 12.

AC power supply 3 outputs AC voltage and is a system power supply such as a commercial power supply which outputs AC voltage of 100 V to 242 V, for example.

As illustrated in FIG. 12, lighting circuit 1B includes power supplier 11, power controller 12, control power supply 13, and characteristics detector 14B. Furthermore, lighting circuit 1B includes output terminals 101, 102, and 103.

Lighting circuit 1B according to this embodiment is different from lighting circuit 1 according to Embodiment 1 in terms of the configuration of characteristics detector 14B. The configuration of characteristics detector 14B is described below.

Characteristics detector 14B is a circuit that detects characteristics of LED module 2 based on the identification signal. Characteristics detector 14B outputs to power controller 12 voltage determined based on the result of the detection. This voltage corresponds to a target value of current which power supplier 11 outputs. As illustrated in FIG. 12, characteristic detector 14B includes IC (integrated circuit) 15, resistors 141, 142, 145, 147, 148*a*, 148*b*, 148*c*, and 149, diode 143, capacitor 146, and transistors 150*a* and 150*b*.

IC 15 is a circuit for detecting voltage $V_{in}$ of the identification signal (that is, voltage at second connection terminal 222 of LED module 2). IC 15 includes comparators 151 and 152, and compares voltage $V_{in}$ of the identification signal with high-voltage reference voltage $V_U$ and low-voltage reference voltage $V_L$. Characteristics detector 14B determines, based on a value of voltage $V_{in}$ of the identification signal, reference voltage (preset voltage) $V_{RL}$ which is input to power controller 12. Reference voltage $V_{RL}$ corresponds to a preset value of current that is supplied to LED module 2 according to resistance value $R_{23}$ of characteristics setter 23 (an identification resistor) between second connection terminal 222 and third connection terminal 223 of LED module 2. A method of determining reference voltage $V_{RL}$ by characteristics detector 14B will be described later in detail.

Comparator 151 is a circuit that compares voltage $V_{in}$ of the identification signal and high-voltage reference voltage $V_U$. Reference voltage $V_U$ and voltage $V_{in}$ of the identification signal are respectively input to a non-inverting input terminal and an inverting input terminal of comparator 151.

Comparator 152 is a circuit that compares voltage $V_{in}$ of the identification signal and low-voltage reference voltage $V_L$. Voltage $V_{in}$ of the identification signal and reference voltage $V_L$ are respectively input to a non-inverting input terminal and an inverting input terminal of comparator 152.

Resistors 141, 142, and 145 are elements among which voltage applied by control power supply 13 is divided and that are used for generating high-voltage reference voltage $V_U$ and low-voltage reference voltage $V_L$. Resisters 141, 142, and 145 are connected in series in the stated order and are connected to an output end of control power supply 13. Accordingly, high-voltage reference voltage $V_U$ is generated at a connection point between resistor 141 and resistor 142, and low-voltage reference voltage $V_L$ is generated at a connection point between resistor 142 and resistor 145. The connection point between resistor 141 and resistor 142 is connected to the non-inverting input terminal of comparator 151, and the connection point between resistor 142 and resistor 145 is connected to the non-inverting input terminal of comparator 152.

Diode 143 is a rectifying element for preventing current from flowing toward control power supply 13.

Resistor 144 is an element with which voltage applied by control power supply 13 is divided. Resistor 144 is connected to second connection terminal 222 of LED module 2. Thus, voltage $V_{in}$ of the identification signal is applied to this connection point. How to determine resistance values $R_{144}$ and $R_{23}$ will be described later in detail.

Capacitor 146 is an element for reducing noise that is added to the identification signal.

Resistors 148*a*, 148*b*, 148*c*, and 149 are elements among which voltage applied by control power supply 13 is divided and that are used for generating reference voltage (preset voltage) $V_{RL}$ that is input to power controller 12. Reference voltage $V_{RL}$ corresponds to a preset value of current that is supplied to LED module 2 according to resistance value $R_{23}$ of characteristics setter 23 between second connection terminal 222 and third connection terminal 223 of LED module 2.

Transistor 150*a* is turned ON or OFF according to a level of an output signal of comparator 151. When voltage $V_{in}$ of the identification signal is higher than reference voltage $V_U$, comparator 151 outputs a HIGH signal. With this, transistor 150*a* is turned ON. When voltage $V_{in}$ of the identification signal is lower than reference voltage $V_U$, comparator 151 outputs a LOW signal. With this, transistor 150*a* is turned OFF.

Likewise, transistor 150*b* is turned ON or OFF according to a level of an output signal of comparator 152. When voltage $V_{in}$ of the identification signal is higher than reference voltage $V_L$, comparator 152 outputs a HIGH signal. With this, transistor 150*b* is turned ON. When voltage $V_{in}$ of the identification signal is lower than reference voltage $V_L$, comparator 152 outputs a LOW signal. With this, transistor 150*b* is turned OFF.

Thus, combinations of ON and OFF states of transistors 150*a* and 150*b* are used to determine reference voltage $V_{RL}$.

With the above-described configuration of lighting circuit 1B, voltage $V_{in}$ of the identification signal, that is, voltage $V(R_{23})$ of characteristics setter 23, is determined as follows according to resistance value $R_{23}$ of characteristics setter 23 of LED module 2.

The relationship between (i) voltage $V_{in}$ of the identification signal and (ii) characteristics setter 23, resistor 117, and resistor 144 is described below.

As illustrated in FIG. 12, characteristics setter 23, resistor 117, and resistor 144 are connected in series when viewed in the equivalent circuit schematic. Resistance value $R_{117}$ of resistor 117 is sufficiently smaller than resistance value $R_{23}$ of characteristics setter 23, and therefore resistor 117 can be ignored. Accordingly, voltage $V_{in}$ of the identification signal is represented by Expression 3 below.

$$V_{in}=V_{cc}\times R_{23}/(R_{144}+R_{23}) \quad \text{Expression 3}$$

Resistance values $R_{233}$ and $R_{144}$ and resistance values of resistors 141, 142, and 145 are determined in such a way that voltage $V_{in}$ of the identification signal represented by Expression 3 is higher than low-voltage reference voltage $V_L$ and lower than high-voltage reference voltage $V_U$.

3-3. Operation Performed by Lighting Circuit

Next, an operation performed by lighting circuit 1B is described with reference to the drawings.

Characteristics detector 14B of lighting circuit 1B applies voltage to second connection terminal 222 of LED module 2 and detects $V_{in}$ of the identification signal. Then, characteristics detector 14B compares voltage $V_{in}$ of the identification signal with reference voltage $V_U$ and reference voltage $V_L$, to determine reference voltage $V_{RL}$.

Lighting circuit 1B inputs reference voltage $V_{RL}$ that corresponds to the present output, from characteristics detector 14B to power controller 12, to perform such feedback control that voltage corresponding to the output current of power supplier 11 (voltage $V(R_{117})$ across resistor 117) is substantially equal to reference voltage $V_{RL}$.

In detail, in power controller 12, comparator 122 receives reference voltage $V_{RL}$ of the output at a positive input terminal, and receives, at a negative input terminal, voltage $V(R_{117})$ occurring across resistor 117 according to current flowing to LED 21. Turn-ON and turn-OFF operations of switching element 113 are controlled so as to set voltage $V(R_{117})$ across resistor 117 to reference voltage $V_{RL}$.

Reference voltage $V_{RL}$ is an output voltage that decreases stepwise as resistance value $R_{23}$ of characteristics setter 23 that identifies a lamp increases, as explained below. Thus, reference voltage $V_{RL}$ decreases stepwise as resistance value $R_{23}$ increases.

Reference voltage $V_{RL}$ is determined in the following manner.

With control power supply 13, current flows along the path from rectifier 111 to resistor 131 to Zener diode 132, and voltage $V_{cc}$ occurs across Zener diode 132.

Furthermore, current flows along the path from Zener diode 132 to diode 143 to resistor 144 to characteristics setter $R_{23}$, and voltage $V(R_{23})$ ($=V_{in}$) occurs across characteristics setter 23. Capacitor 146 is for noise removal.

Accordingly, if a reverse voltage of diode 143 is ignored, voltage $V(R_{23})$ across characteristics setter 23 is represented by Expression 4 below.

$$V(R_{23})=R_{23}/(R_{144}+R_{23})\times V_{cc} \quad \text{Expression 4}$$

Meanwhile, the circuit in which resistors 141, 142, and 145 are connected in series is connected in parallel with Zener diode 132, and therefore, voltage $V_U$ at a connection point between resistors 141 and 142 and voltage $V_L$ at a connection point between resistors 142 and 145 are respectively those represented by Expression 5 and Expression 6 below.

$$V_U=(R_{142}+R_{145}/(R_{141}+R_{142}+R_{145})\times V_{cc} \quad \text{Expression 5}$$

$$V_L=R_{145}/(R_{141}+R_{142}+R_{145})\times V_{cc} \quad \text{Expression 6}$$

Voltage $V_U$ is input to a positive input terminal of comparator 151, and voltage $V_L$ is input to a positive input terminal of comparator 152.

A midpoint potential between resistor 144 and characteristics setter 23 described above, that is, voltage $V(R_{23})$, is input to a negative input terminal of each of comparators 151 and 152.

Reference voltage $V_{RL}$ is determined for each of the following conditions according to voltage $V(R_{23})$ which occurs according to resistance value $R_{23}$ of characteristics setter 23. With this, reference voltage $V_{RL}$ is determined as a step-like signal voltage.

1. When $0<V(R_{23})<V_L$

Comparator 151 outputs a HIGH signal, and transistor 150*a* is turned ON. Comparator 152 outputs a HIGH signal, and transistor 150*b* is turned ON.

Therefore, reference voltage $V_{RL}$ is represented by Expression 7 below.

$$V_{RL}=V(R_{149})=R_{149}/(R_{148a}+R_{149})\times V_{cc} \quad \text{Expression 7}$$

2. When $V_L<V(R_{23})<V_U$

Comparator 151 outputs a HIGH signal, and transistor 150*a* is turned ON. Comparator 152 outputs a LOW signal, and transistor 150*b* is turned OFF.

Therefore, reference voltage $V_{RL}$ is represented by Expression 8 below.

$$V_{RL}=V(R_{149})=R_{149}/(R_{148a}+R_{148c}+R_{149})\times V_{cc} \quad \text{Expression 8}$$

3. When $V_U<V(R_{23})$

Comparator 151 outputs a LOW signal, and transistor 150*a* is turned OFF. Comparator 152 outputs a LOW signal, and transistor 150*b* is turned OFF.

Therefore, reference voltage $V_{RL}$ is represented by Expression 9 below.

$$V_{RL}=V(R_{149})=R_{149}/(R_{148a}+R_{148b}+R_{148c}+R_{149})\times V_{cc} \quad \text{Expression 9}$$

Reference voltage $V_{RL}$ is input to the positive input terminal of comparator 122.

Differences in voltage are represented by Expression 10 below.

$$R_{149}/(R_{148a}+R_{148b}+R_{148c}+R_{149})\times V_{cc}$$

$$<V(R_{149})=R_{149}/(R_{148a}+R_{148c}+R_{149})\times V_{cc}$$

$$<V(R_{149})=R_{149}/(R_{148a}+R_{149})\times V_{cc} \quad \text{Expression 10}$$

Thus, a lower voltage $V(R_{149})$ occurs across $R_{149}$ as voltage $V(R_{23})$ across characteristics setter 23 increases.

Furthermore, voltage $V(R_{149})$ has a constant value regardless of changes in resistance value $R_{23}$ of characteristics setter 23 while $V(R_{23})$ is in each range of conditions 1, 2, and 3 above.

With reference voltage $V_{RL}$ determined as described above, reference voltage $V_{RL}$ is a signal voltage that decreases stepwise.

Figure 13:
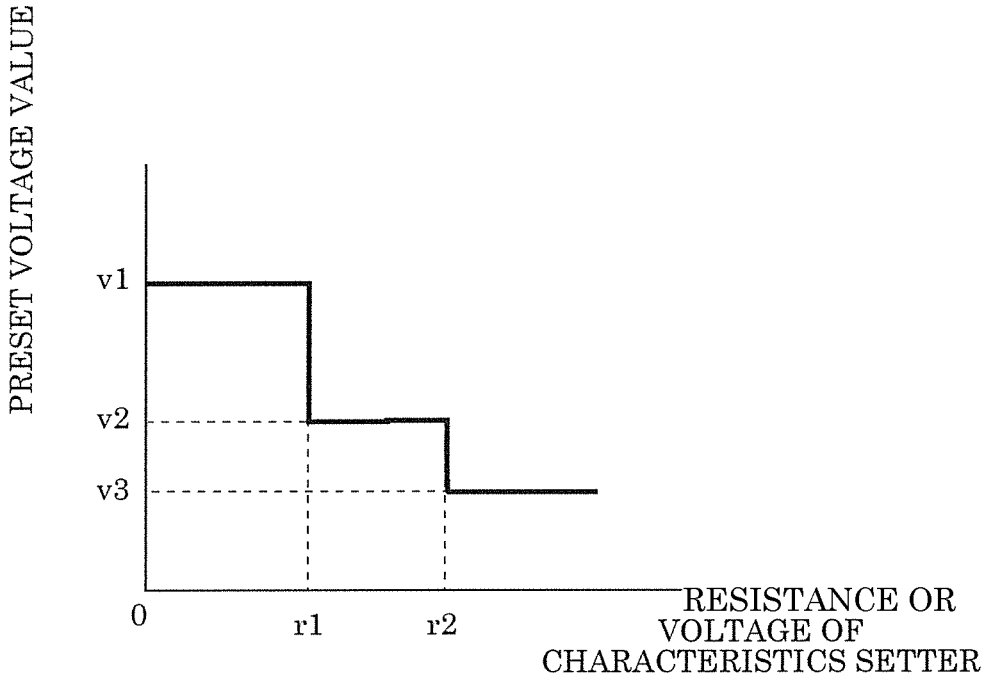
FIG. 13 shows the relationship between a preset voltage value (reference voltage) and voltage that occurs at a characteristics setter with a lighting circuit illustrated in FIG. 12.

FIG. 13 shows the relationship between a preset voltage value (=reference voltage $V_{RL}$) and the resistance value $R_{23}$ of the characteristic setter 23 which is proportional to the voltage V ($R_{23}$) which occurs across characteristics setter 23 with the circuit of FIG. 12.

Here, v1, v2, and v3 in FIG. 13 are represented by Expression 11, Expression 12, and Expression 13 below, respectively.

$$v1=R_{149}/(R_{148a}+R_{149})\times V_{cc} \quad \text{Expression 11}$$

$$v2=R_{149}/(R_{148a}+R_{148c}+R_{149})\times V_{cc} \quad \text{Expression 12}$$

$$v3=R_{149}/(R_{148a}+R_{148b}+R_{148c}+R_{149})\times V_{cc} \quad \text{Expression 13}$$

In addition, r1 and r2 in this figure are represented by Expression 14 and Expression 15 below, respectively.

$$r1\propto V_U=R_{145}/(R_{141}+R_{142}+R_{145})\times V_{cc} \quad \text{Expression 14}$$

$$r2\propto V_L=(R_{142}+R_{145})/(R_{141}+R_{142}+R_{145})\times V_{cc} \quad \text{Expression 15}$$

Since resistance value $R_{23}$ of characteristics setter 23 and voltage $V(R_{23})$ which occurs across characteristics setter 23 have a proportional relationship, the relationship between voltage $V(R_{23})$ which occurs across characteristics setter 23 and a value of current that flows through LED 21 can be simply replaced by the relationship between resistance value $R_{23}$ of characteristics setter 23 and a preset current value. In other words, a preset current is a step-like current having a value that remains constant while resistance value $R_{23}$ of the characteristics setter is in a predetermined range, and decreases as the resistance value of the characteristics setter increases.

Figure 14:
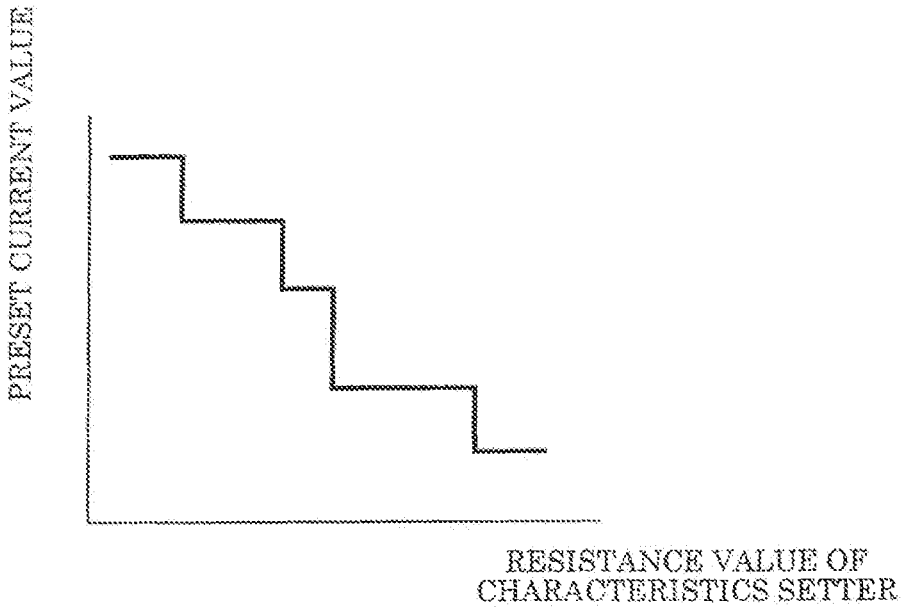
FIG. 14 shows the relationship between a preset current value and a resistance value of a characteristics setter with a lighting circuit according to Embodiment 3.

In characteristics detector 14B illustrated in FIG. 12, the number of resistors connected to an input side and an output side of IC 15, and resistance values thereof, can be changed to change the number of changes in resistance value $R_{23}$ of characteristics setter 23 and the preset current value (the number of steps), and values thereof, as shown in FIG. 14, for example. In this case, the number of comparators in IC 15 and the number of transistors connected to the comparators in IC 15 may be changed as well.

In lighting circuit 1B according to this embodiment, the value of voltage for passing current through an LED decreases as the resistance value of the characteristics setter which is used for identifying the LED increases as described above, and therefore, control to reduce the output voltage is possible even when the characteristics setter has a large resistance value in association with an increase in the temperature of a device or a COB due to an abnormal condition or the like. Thus, it is possible to provide a safe current supply without damaging the LED module.

Since the preset current is the step-like current, it is possible to perform the control that is not affected by variation in the resistance value of characteristics setter 23 or a shift of the preset value due to a change in temperature.

Furthermore, the step-like preset current makes it easy for a user to recognize a change in settings. In addition, the control of lighting circuit 1B can be performed using digital values.

3-4. Advantageous Effects, Etc.

As described above, lighting circuit 1B according to this embodiment supplies current to LED module 2 which is a solid-state light-emitting element module. LED module 2 includes LED 21 which is a solid-state light-emitting element, and characteristics setter 23 connected to one end and the other end of LED 21. Lighting circuit 1B includes characteristics detector 14B which measures a resistance value of characteristics setter 23, and power controller 12 which supplies voltage for passing a preset current through LED module 2 when characteristics detector 14B measures a resistance value of characteristics setter 23.

The preset current is a step-like current having a value that remains constant while the resistance value of characteristics setter 23 is in a predetermined range, and decreases as the resistance value of characteristics setter 23 increases. On the basis of the resistance value of characteristics setter 23, characteristics detector 14B outputs to power controller 12 reference voltage $V_{RL}$ which decreases stepwise as the resistance of characteristics setter 23 increases. Power controller 12 adjusts, based on reference voltage $V_{RL}$, voltage for passing the preset current through LED module 2.

With this, the value of voltage for passing current through LED 21 decreases as the resistance value of characteristics setter 23 which is used for identifying LED 21 increases, and therefore, control to reduce the output voltage is possible even when characteristics setter 23 has a large resistance value in association with an increase in the temperature of a device or a COB due to an abnormal condition or the like. Thus, it is possible to provide a safe current supply without damaging LED module 2.

Since the preset current is the step-like current, it is possible to perform the control that is not affected by variation in the resistance value of characteristics setter 23 or a shift of the preset value due to a change in temperature. In this case, the range of the preset current value that is constant with respect to a variation range of the resistance value is preferably set to be wide.

Furthermore, the step-like preset current makes it easy for a user to recognize a change in settings. In addition, the preset current, specifically, voltage that is applied to LED 21, can be controlled using digital values, and therefore it is possible to easily perform control such as dimming. For example, 256-level dimming is possible by the use of a 256-stage flip-flop circuit. Moreover, since the preset current, specifically, the voltage that is applied to the LED, can be controlled using digital values, there is no need to use a digital-analog converter circuit, meaning that digital control on the lighting circuit is possible with a simple configuration.

Embodiment 4

Figure 15:
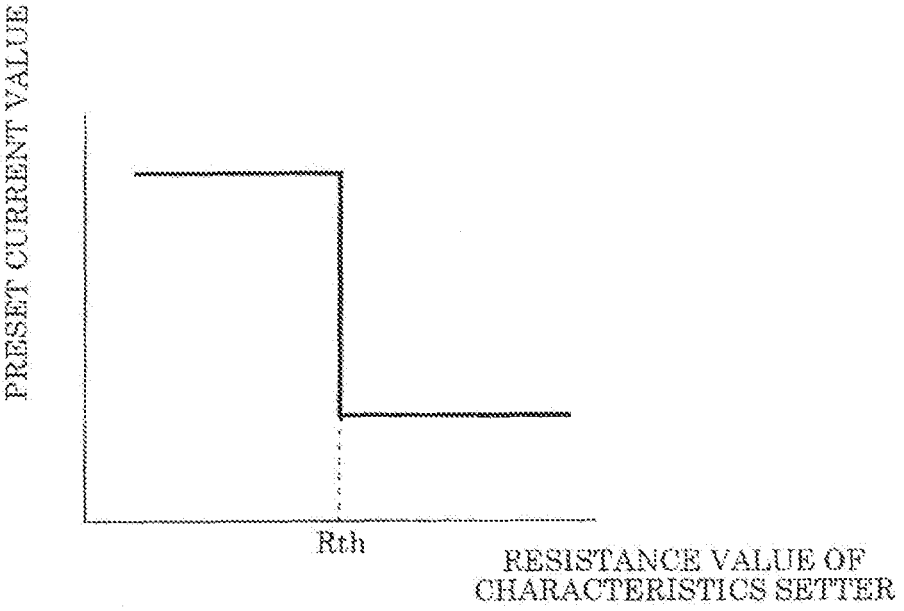
FIG. 15 shows the relationship between a preset current value and a resistance value of a characteristics setter with a lighting circuit according to Embodiment 4.

Next, Embodiment 4 is described. FIG. 15 shows the relationship between a preset current value and a resistance value of a characteristics setter with a lighting circuit according to Embodiment 4.

The lighting circuit according to this embodiment is different from lighting circuit 1B according to Embodiment 3 in that the preset current is set to one of two different current values depending on whether resistance value $R_{23}$ of the characteristics setter is larger or smaller than a predetermined value.

As shown in FIG. 15, the preset current value is set to a HIGH level when resistance value $R_{23}$ of characteristics setter 23 is smaller than $R_{th}$, and the preset current value is set to a LOW level when resistance value $R_{23}$ of characteristics setter 23 is larger than $R_{th}$. In short, the lighting circuit according to this embodiment has, as the preset current value, two different values one of which is selected according to $R_{th}$ which is a threshold value.

With this configuration, a difference does not occur in the output current value even when resistance value $R_{23}$ of characteristics setter 23 varies, and thus it is possible to control LED 21 so that the brightness of LED 21 is constant. Therefore, even a resistor that does not have high tolerance to a change in temperature can be used as the characteristics setter, allowing a lighting circuit to be formed with a low cost.

Note that the preset current value is not limited to two different values, which is described above, and may be three or more different values.

Embodiment 5

Figure 16:
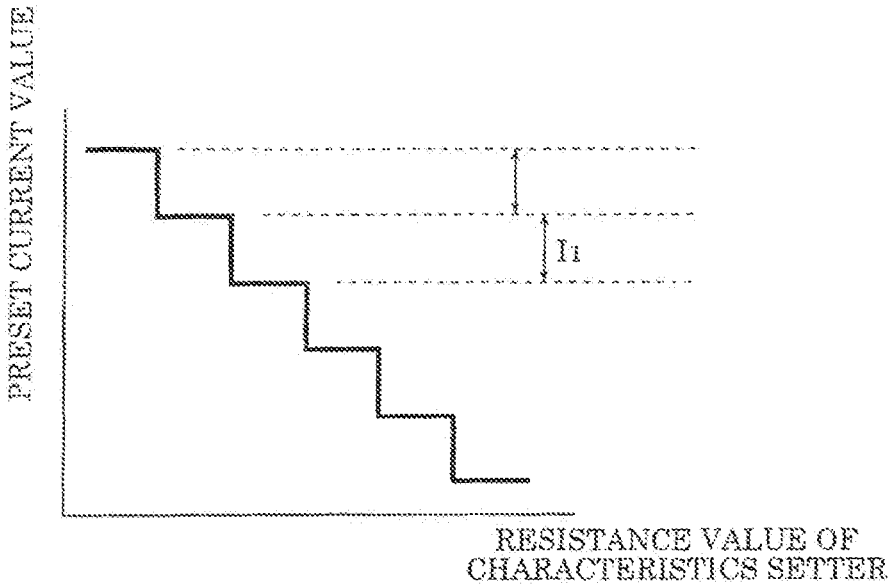
FIG. 16 shows the relationship between a preset current value and a resistance value of a characteristics setter with a lighting circuit according to Embodiment 5.

Next, Embodiment 5 is described. FIG. 16 shows the relationship between a preset current value and a resistance value of a characteristics setter with a lighting circuit according to Embodiment 5.

The lighting circuit according to this embodiment is different from lighting circuit 1B according to Embodiment 3 in that the preset current value changes stepwise by a constant decrement with respect to a constant increment of resistance value $R_{23}$ of characteristics setter 23.

As shown in FIG. 16, the lighting circuit according to this embodiment changes the preset current when the resistance value of characteristics setter 23 changes by a constant value. Assume herein that value $I_1$ of a change in the preset current is a constant value. To put it differently, as shown in FIG. 16, the lighting circuit according to this embodiment performs the control that decreases the preset current value stepwise by constant value $I_1$ with respect to a change in the resistance value.

With this configuration, a user can easily recognize a change in settings, and the control can be easy.

Embodiment 6

Figure 17:
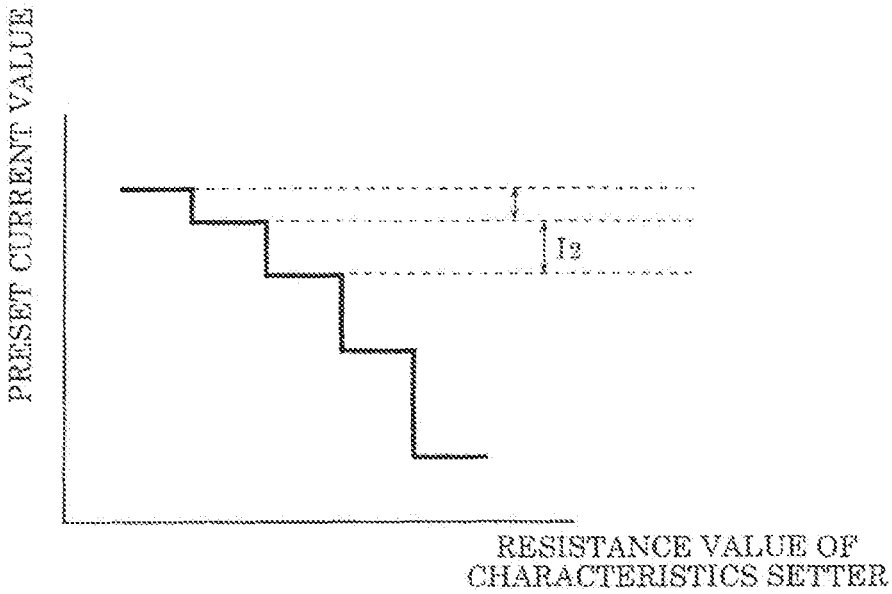
FIG. 17 shows the relationship between a preset current value and a resistance value of a characteristics setter with a lighting circuit according to Embodiment 6.

Next, Embodiment 6 is described. FIG. 17 shows the relationship between a preset current value and a resistance value of a characteristics setter with a lighting circuit according to Embodiment 6.

The lighting circuit according to this embodiment is different from lighting circuit 1B according to Embodiment 3 in that the decrement of the preset current value decreases as resistance value $R_{23}$ of characteristics setter 23 decreases.

As shown in FIG. 17, the lighting circuit according to this embodiment sets value $I_2$ of a change in the preset current to a small value in the range where resistance value $R_{23}$ of characteristics setter 23 is small. The preset current is controlled in such a way that value $I_2$ of a change in the preset current gradually increases as resistance value $R_{23}$ of characteristics setter 23 increases. In other words, as shown in FIG. 17, the control is performed so that the decrement of the preset current that decreases stepwise increases as resistance value $R_{23}$ of characteristics setter 23 increases. Note that any method may be used to set resistance value $R_{23}$ of characteristics setter 23, and any method may also be used to set value $I_2$ of a change in the preset current. For example, resistance value $R_{23}$ of characteristics setter 23 may be set in such a way that for each of constant increments thereof, the preset current decreases, or resistance value $R_{23}$ of characteristics setter 23 may be set in such a way that for each of different increments thereof, the preset current decreases.

With this configuration, it is possible to efficiently control even LED 21 that has different current characteristics depending on whether resistance value $R_{23}$ of characteristics setter 23 is large or small. Particularly, even in the case of using LED 21 having characteristics that the value of a change in the current is small in the range where the resistance value is small and the value of a change in the current is large in the range where the resistance value is large, accurate control is possible because the preset current value is delicately controlled in the range of resistance value $R_{23}$ of characteristics setter 23 where the change in the current is small.

Embodiment 7

Figure 18:
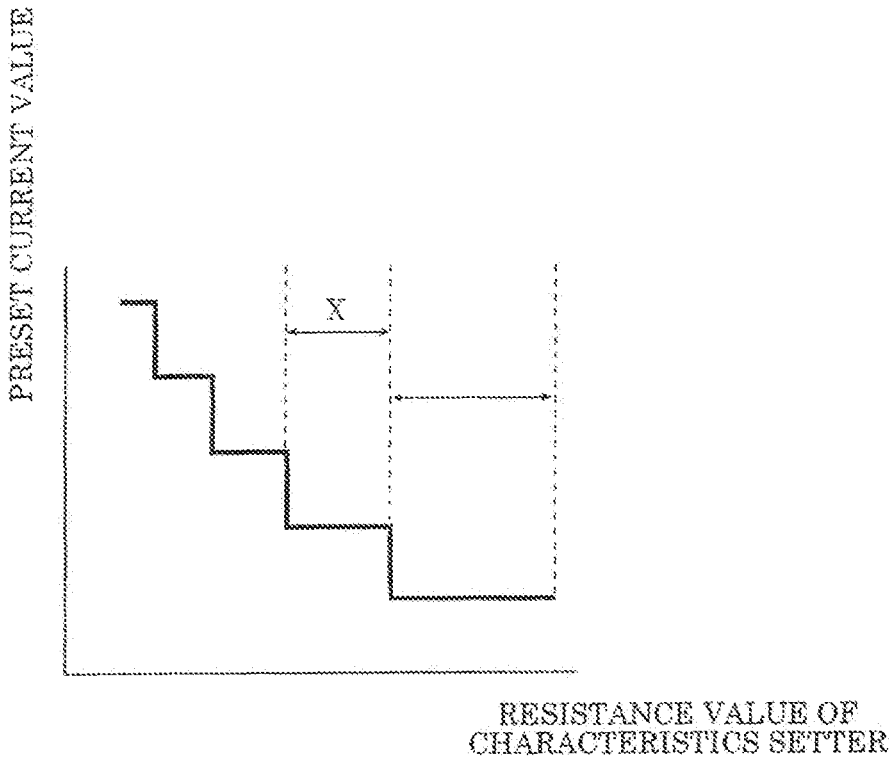
FIG. 18 shows the relationship between a preset current value and a resistance value of a characteristics setter with a lighting circuit according to Embodiment 7.

Next, Embodiment 7 is described. FIG. 18 shows the relationship between a preset current value and a resistance value of a characteristics setter with a lighting circuit according to Embodiment 7.

The lighting circuit according to this embodiment is different from lighting circuit 1B according to Embodiment 3 in that the predetermined increment of resistance $R_{23}$ of characteristics setter 23 decreases as resistance value $R_{23}$ of characteristics setter 23 decreases.

As shown in FIG. 18, the lighting circuit according to this embodiment sets, to a small value, range X of the resistance value where the preset current remains constant, when resistance value $R_{23}$ of characteristics setter 23 is small. The preset current is controlled in such a way that range X where the preset current remains constant gradually increases as resistance value $R_{23}$ of characteristics setter 23 increases. Note that any method may be used to set resistance value $R_{23}$ of characteristics setter 23, and any method may also be used to set a value of a change in the preset current. For example, resistance value $R_{23}$ of characteristics setter 23 may be set in such a way that for each of constant increments thereof, the preset current decreases, or resistance value $R_{23}$ of characteristics setter 23 may be set in such a way that for each of different increments thereof, the preset current decreases.

With this configuration, even in the case of using LED 21 having characteristics that the change in the current amount is large in the range where the resistance value is small and the change in the current amount is small in the range where the resistance value is large, accurate control is possible when resistance value $R_{23}$ of characteristics setter 23 which switches the preset current value is delicately controlled in the range of the resistance value where the change in the current amount is large.

Embodiment 8

Next, an illumination system according to Embodiment 8 is described.

Figure 19:
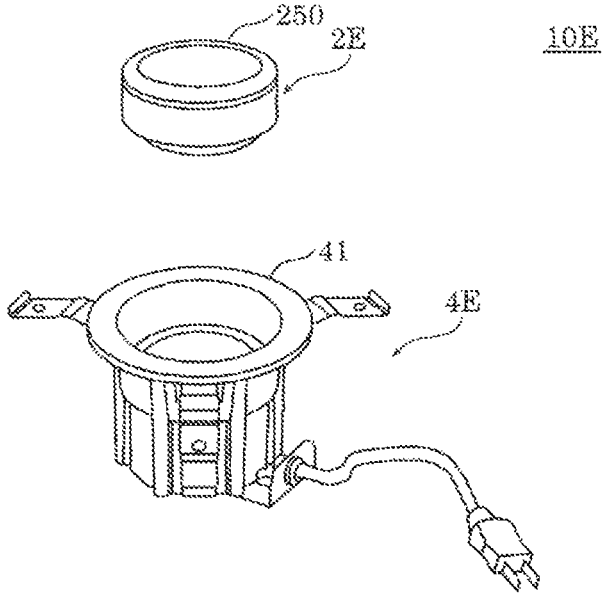
FIG. 19 is an external view of an illumination system according to Embodiment 8.

FIG. 19 is an external view of illumination system 10E according to this embodiment. Illumination system 10E illustrated in FIG. 19 includes luminaire 4E and LED module 2E. Luminaire 4E includes one of lighting circuits 1, 1A, and 1B according to the above embodiments and socket 6 (see FIG. 1) for connecting LED module 2E. In this embodiment, luminaire 4E is a downlight, and includes lamp mount 41 which houses the lighting circuit and to which LED module 2E is fitted. LED module 2E includes the same or similar circuit as that included in LED module 2, and includes housing 250 having, on an external surface, plug 22 for connecting to socket 6 of luminaire 4E.

Since illumination system 10E described above includes one of lighting circuits 1, 1A, and 1B according to the above embodiments, illumination system 10E is capable of producing the same or similar advantageous effects as those produced by a corresponding one of lighting circuits 1, 1A and 1B according to the above embodiments.

VARIATIONS AND OTHERS

Although the lighting circuit, the luminaire, and the illumination system according to the embodiments have been described above, the present disclosure is not limited to these embodiments.

For example, although LED 21 is formed of an SMD LED element in the above embodiments, this is not the only example. For example, an LED chip mounted on a substrate per se may be adopted as LED 21.

Furthermore, although LED 21 is used as a solid-state light-emitting element in the above embodiments, other solid-state light-emitting elements such as an organic EL (electroluminescence) element may be used.

Furthermore, although power controller 12 makes an adjustment so that the current that is supplied to LED module 2 increases as resistance value $R_{233}$ between third connection terminal 223 and second connection terminal 222 increases in the above embodiments, the way to adjust the current is not limited to this example. For example, the circuit configuration of power controller 12 may be changed to make an adjustment so that the current that is supplied to LED module 2 decreases as resistance value $R_{233}$ increases.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting circuit which supplies current to a solid-state light-emitting element module including a solid-state light-emitting element, and first, second, and third connection terminals, the lighting circuit comprising:

a characteristics detector that detects an open circuit between the third connection terminal and the second connection terminal; and a power controller that adjusts current that is supplied between the first connection terminal and the third connection terminal to the solid-state light-emitting element of the solid-state light-emitting element module, to a predetermined value greater than zero, when the characteristics detector detects the open circuit between the third connection terminal and the second connection terminal.

2. The lighting circuit according to claim 1, wherein the characteristics detector detects the open circuit between the third connection terminal and the second connection terminal by measuring a value of resistance between the third connection terminal and the second connection terminal.

3. The lighting circuit according to claim 1, wherein when the characteristics detector does not detect the open circuit between the third connection terminal and the second connection terminal, the power controller adjusts, based on a value of resistance between the third connection terminal and the second connection terminal, the current that is supplied to the solid-state light-emitting element module.

4. The lighting circuit according to claim 3, wherein the power controller increases the current that is supplied to the solid-state light-emitting element module as the value of resistance between the third connection terminal and the second connection terminal increases.

5. The lighting circuit according to claim 1, further comprising a connection determiner that determines whether or not the solid-state light-emitting element module is connected to the lighting circuit, and deactivates the lighting circuit when the connection determiner determines that the solid-state light-emitting element module is not connected.

6. A luminaire comprising the lighting circuit according to claim 1.

7. The luminaire according to claim 6, further comprising a socket that is connected to the first connection terminal, the second connection terminal, and the third connection terminal.

8. A lighting circuit which supplies current to a solid-state light-emitting element module including: a solid-state light-emitting element and an identification resistor, the lighting circuit comprising:

a characteristics detector that measures a resistance value of the identification resistor; and a power controller that supplies voltage for passing a preset current through the solid-state light-emitting element module when the characteristics detector measures the resistance value of the identification resistor, wherein the preset current is a step-like current having a value that remains constant while the resistance value of the identification resistor is in a predetermined range, and decreases as the resistance value of the identification resistor increases, the characteristics detector outputs a reference voltage to the power controller based on the resistance value of the identification resistor, the reference voltage decreasing stepwise as the resistance value of the identification resistor increases, and the power controller adjusts, based on the reference voltage, voltage for passing the preset current through the solid-state light-emitting element module.

9. The lighting circuit according to claim 8, wherein the preset current is set to one of two different current values depending on whether the resistance value of the identification resistor is larger or smaller than a predetermined value.

10. The lighting circuit according to claim 8, wherein the preset current is a step-like current that decreases by a predetermined value for each predetermined increment of the resistance value of the identification resistor.

11. The lighting circuit according to claim 10, wherein the predetermined increment of the resistance value of the identification resistor increases as the resistance value of the identification resistor increases.

12. The lighting circuit according to claim 8, wherein the preset current is a step-like current that decreases by a predetermined value for each constant increment of the resistance value of the identification resistor.

13. The lighting circuit according to claim 12, wherein a decrement of the preset current decreases as the resistance value of the identification resistor decreases.

14. A luminaire comprising the lighting circuit according to claim 8.

15. An illumination system comprising:

the luminaire according to claim 6; and the solid-state light-emitting element module.

16. An illumination system comprising:

the luminaire according to claim 14; and the solid-state light-emitting element module.

* * * * *